United States Patent [19]

Gorrafa

[11] Patent Number: 4,922,593

[45] Date of Patent: May 8, 1990

[54] SYSTEM FOR PREPARING HIGHLY COHERENT AIR JET TEXTURED YARN

[75] Inventor: Adly A. Gorrafa, Hockessin, Del.

[73] Assignee: E. I. Du Pont de Nemours and Company, Wilmington, Del.

[21] Appl. No.: 302,898

[22] Filed: Jan. 30, 1989

Related U.S. Application Data

[63] Continuation-in-part of Ser. No. 178,961, Apr. 7, 1988.

[51] Int. Cl.[5] ..... D02G 1/16

[52] U.S. Cl. ..... 28/254; 28/273

[58] Field of Search ..... 28/273, 254

[56] References Cited

U.S. PATENT DOCUMENTS

| | | | |
|---|---|---|---|
| 3,402,446 | 9/1968 | Benson | 28/1 |
| 3,835,510 | 7/1974 | Koslowski | 28/1.4 |
| 3,881,231 | 5/1975 | Price et al. | 28/1.4 |
| 3,892,020 | 7/1975 | Koslowski | 28/273 |
| 4,097,975 | 7/1978 | Moeller | 28/254 |
| 4,104,770 | 8/1978 | Massey et al. | 28/257 |
| 4,148,116 | 4/1979 | Price | 28/254 |
| 4,157,605 | 6/1979 | Agers | 28/254 |
| 4,183,123 | 1/1980 | Tanaka et al. | 28/273 |
| 4,507,833 | 4/1985 | Simmen | 28/254 |

FOREIGN PATENT DOCUMENTS

| | | | |
|---|---|---|---|
| 697716 | 11/1964 | Canada | 28/273 |
| 48-20176 | 6/1973 | Japan | 28/273 |
| 50-20628 | 7/1975 | Japan | 28/273 |

OTHER PUBLICATIONS

Denton, Textile Month, "Air Texturing and Intermingling", pp. 34–37, Jan. 1988.

Acar and Wray, vol. of Journal of Textile Institute, "An Analysis of Air-Jet Yarn-Texturing Process", Part VII, 1986.

*Primary Examiner*—Werner H. Schroeder

[57] ABSTRACT

In a system for air-jet texturing yarn a yarn treating jet is modified to locate a baffle at the outlet end of the jet. The baffle is positioned a fixed distance above the central axis of the jet and away from the outlet end of the jet such that the yarn and air follow the lower surface of the baffle to a point where the yarn leaves the baffle to increase windup tension and provide a highly coherent textured yarn.

10 Claims, 5 Drawing Sheets

4
100
37
22
37a
68
100
4
60
37
22
64
62
B
YARN PATH 1
YARN PATH 2
C
A
37a
66
68

SYSTEM FOR PREPARING HIGHLY COHERENT AIR JET TEXTURED YARN

This is a continuation-in-part of application Ser. No. 07/178,961 filed Apr. 7, 1988.

BACKGROUND OF THE INVENTION

This invention relates to a system for preparing highly coherent textured yarn, and more particularly it relates to a system for preparing such yarns with pressurized fluid in a jet having a deflector arrangement at its outlet end.

It is known to overfeed one, or more, ends of continuous multifilament yarns to a jet, in which pressurized fluid such as air acts on the filaments to splay them, curl them into crunodal loops, entangle the looped filaments into coherent yarn.

Fluid jet processes are also known for texturing or bulking yarn that employ both movable and fixed baffles positioned at various distances from the outlet end of the jet and at various angles to the yarn path to deflect yarn and fluid from a straight path as they leave the jet.

In making a yarn having crunodal loops, the texturing jet must forward the overfed yarn under sufficient tension to keep the yarn from wrapping on the feed rolls, and this tension is provided by the drag of the pressurized air which is moving much faster than the yarn. The air opens the yarn, whips the filaments about, forms loops in the filaments, then entangles them together into a structure which can retain the loops under the tensions which such yarns encounter when made into fabrics. The tension must be low at the jet exit to accumulate loops and form the entangled structure. Immediately thereafter, higher tension is desired to tighten the entangled structure and stabilize it.

A baffle against which the air and yarn impinge is often provided at the exit to provide a controlled air zone and to change the direction of yarn movement abruptly. Such baffles are especially necessary at high texturing speeds and air pressures. However, with known cylindrical baffle arrangements, the air divides around the baffle, and the portion of the air which follows the yarn continues to exert tension.

In the present invention, the majority or all of the air follows the lower surface of a baffle while the yarn moves around the lower surface of the baffle.

Wind-up tension is a good measure of texturing jet effectiveness in converting filamentary bulking overfeed into loops, which are well consolidated and integrated with each other into a stable and coherent yarn bundle. Good wind-up tension also yields a firm, rather than soft/mushy, textured yarn package. Yarn withdrawal from such firm packages is easy and uniform, without snags and tangles associated with soft, mushy packages.

High wind-up tension in texturing also yields packages with yarn that resists bulk pull-out in subsequent high tension operations, such as warping, tufting or knitting. Poor loop consolidation into the yarn bundle, as evidenced by low wind-up tension, is also undesirable in the finished fabric or carpet. Abrasion on the surface of such fabrics, during use, will generally yield plucked-filaments, scuffing, fuzzing and unattractive appearance in relatively short time. Yarns with well consolidated loops, integrated into a compact yarn bundle, generally resist scuffing and fuzzing longer when converted to fabrics or carpets. Texturing tension is measured post jet, and wind-up tension is measured pre-packaging. There is a parallel relationship between texturing tension and wind-up tension, although the former is generally much lower in magnitude than the latter. Yarns with low texturing tensions show low wind-up tensions, while yarns with high texturing tensions also show wind-up tensions in the high range.

With the present invention, textured yarn wind-up tension increases by a surprising amount, reaching 20 to 100% more than wind-up tension realized under similar conditions with jets of the prior art, such as Agers U.S. Pat. No. 4,157,605.

SUMMARY OF THE INVENTION

The present invention is a system for texturing one or more yarns that includes a source of supply for said yarns, a yarn texturing jet through which yarn passes positioned between a feed means and a take up means for taking textured yarn up onto a package. The jet includes a body having yarn inlet and outlet ends connected by a central bore along a central axis, means for introducing pressurized gas through a gas inlet into said bore between said ends to contact yarn passing through the jet at a location in said bore, said yarn and said gas following a path from said outlet end of said jet. A baffle is located adjacent the yarn outlet end of the jet, the baffle has a peripheral surface, the portion of the surface nearest said outlet end is a distance of 0.1 to 2.0 minimum diameters of the bore downstream of said location where the pressurized gas enters into the bore of the jet and the portion of the baffle surface nearest the central axis is a distance of from 0.1 to 3.0 of said minimum diameters above said central axis.

The baffle may have a circular, curvilinear or polygon cross section. The outlet end of the jet may comprise a curvilinear trumpet-like configuration.

DETAILED DESCRIPTION OF THE PREFERRED EMBODIMENT

Figure 1:
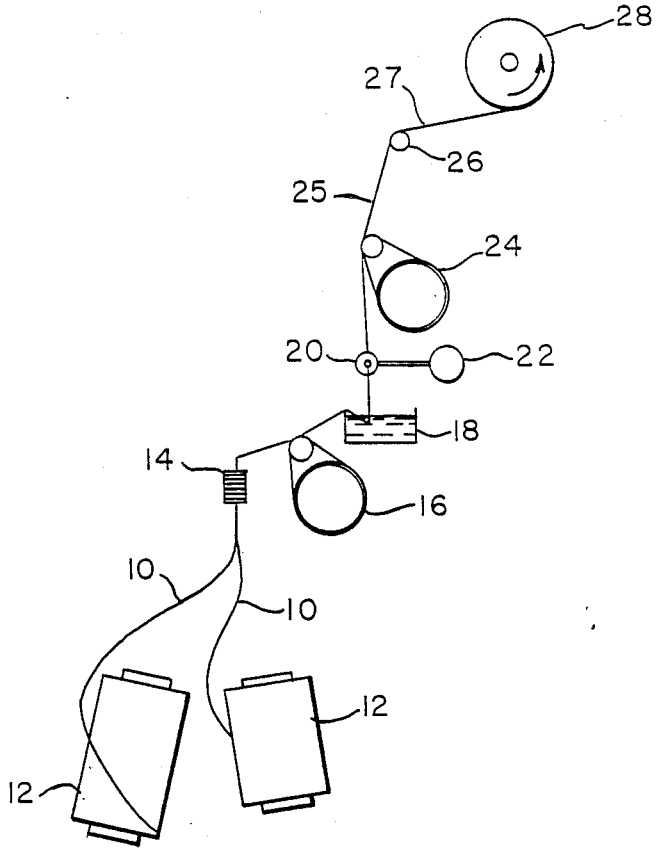
FIG. 1 is a schematic illustration of one embodiment of the system of this invention.

In an embodiment chosen for purposes of illustration, in FIG. 1, feed yarns 10 from a plurality of packages 12, are threaded through tensioner 14 and feed roller 16 to a wetting bath 18 to the inlet of texturing jet 20. Jet is supplied by compressed air from air manifold 22. Textured yarn exiting jet 20, around special baffle fitted to jet exit (not shown), is taken to nip roll 24, over traverse guide bar 26, onto wind up package 28. Speed of feed roll 16 is greater than nip roll 24 to effect a yarn bulking overfeed of from about 5 to about 200% or more. Wind up speed is slightly faster than nip roll 24 speed by about 1 to about 10% or perhaps more. Wind up tension is measured, by a suitable tensiometer, at location 25 on textured yarn 27, and an average reading is taken to avoid tension extremes generated by traversing the yarn onto takeup package.

In core-and effect texturing, effect yarn (not shown) ends are fed to separate feed roll before running through jet 20 without getting wetted. Yarn ends 10 from supply packages 12 taken to feed roll 16 serve as core. Core-and-effect ends are textured together by jet 20 but to different levels of over feeds. A low overfeed level is applied to core yarn ends 10 by the speed ratio of rolls 16 and 24, e.g. in the range of 1.03:1.0 to 1.15:1.0. A high overfeed level is applied to effect yarn ends by the speed ratio of their corresponding feed nip rolls and rolls 24, e.g. in the range of 1.1:1.0 to 2.5:1.0 or more.

Commercial machine of the type shown in FIG. 1 is an Eltex AT, manufactured by Hirschburger GMBH of Reutlingen, West Germany.

Figure 2:
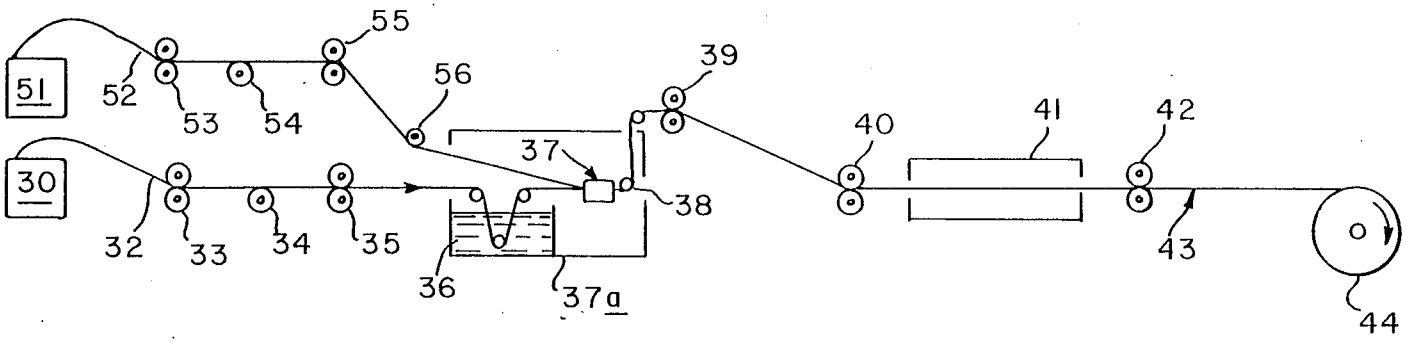
FIG. 2 is a schematic illustration of an alternate embodiment of the system of this invention.

A more detailed system is shown in FIG. 2 wherein feed yarn packages 30 (one is shown) supply multifilament yarn ends 32 to feed rolls 35, which in turn overfeed the yarns to jet 37, after passing through water bath 36 both contained in compartment 37*a*. If feed yarns 32 are polymeric, such as polyester or polyamide, spun without being fully oriented (known in the industry as POY yarn, for being partially oriented yarn), it is common to draw said feed yarn in a drawing zone between rolls 33 and rolls 35. If yarn is polyester POY, it is common to draw it around a hot metallic pin 34 located between rolls 33 and 35. After feeding yarns to jet 37, textured yarn exits the jet around special baffle 38 to rolls 39. A mild cold stretching of 1 to 15% is sometimes applied in the zone between rolls 39 and rolls 40, often called the stabilization zone. High yarn shrinkage, either inherent in the supply feed yarn or generated by the drawing step between rolls 33 and rolls 35, is sometimes reduced by yarn relaxation step between rolls 40 and rolls 42 wherein yarn travels through heated tube 41. After exiting rolls 42, textured yarn is wound around takeup package 44. Windup tension is measured at location 43, as far upstream of textured package 44 as possible, to reduce tension peaks generated by traversing the yarn in winding. An average tension reading is taken. Tension can also be measured in stabilization zone between rolls 39 and rolls 40 to evaluate the effectiveness of the texturing jet 37. Under otherwise identical speed ratios and conditions, the higher the tension in the stabilization zone, the more effective the jet 37 is in converting bulking overfeed to stable, more highly coherent and bulky textured yarn.

For core-and effect texturing, core ends 32 are fed through rolls 33 and 35 to water bath 36 and texturing jet 37 (FIG. 2). Effect yarn ends 52 from supply packages 51 (only one is shown in FIG. 2) are fed through rolls 53 and rolls 55 for drawing on hot pin 54 before guiding them around bar 56 to inlet of texturing jet 37. Commonly, core ends 32 are wetted in bath 36 but effect ends 52 are not wetted, by bypassing the bath. In other schemes, wetting core ends 32 is done by dripping liquid from a suitable orifice (not shown) onto the yarn directly. A typical machine similar to that schematically shown in FIG. 2 is model FK6-T80 manufactured by Barmag Co. of Remscheid, West Germany.

Figures 3, 4:
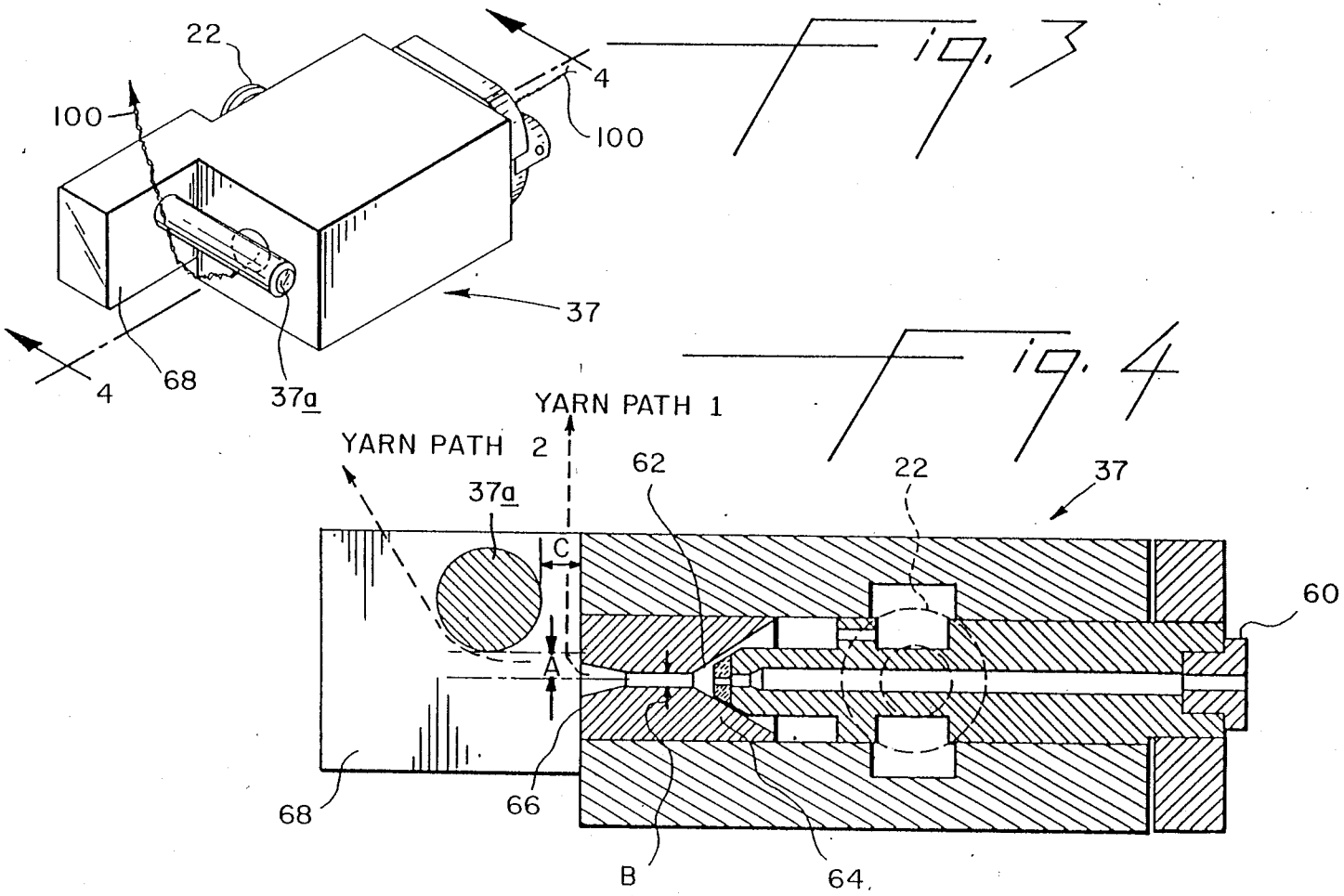
FIG. 3 is a perspective view of the jet used in of this invention.
FIG. 4 is a sectioned view of FIG. 3 taken along line 4—4.

Texturing jet 37, with special exit baffle is described in FIGS. 3 and 4.

In the system of this invention, POY feed yarns are not specifically necessary, but if used, it is common to pre-draw the yarn, with or without heat, before reaching pre-jet feed rolls. Also, a stabilization zone is not specifically necessary but could be used. Also, a heat setting zone, shown between rolls 40 and 42, is not specifically necessary but could be used to modify thermal properties of textured yarn, e.g. boil off shrinkage.

The system of this invention is applicable to all types of filament yarns such as polyester, POY polyester, nylon, POY nylon, polypropylene, POY polypropylene, polyolefin, rayon acetate, glass, and aramid yarns.

The system of this invention is also applicable to yarn manufactured with free-end broken filaments protruding from yarn bundle, in which loops generated by texturing jet 37 are subsequently broken or abraded to single filaments so that yarn produced resembles a hairy spun yarn.

A closer view of the jet 37 in FIGS. 3–7 shows either yarn 10, or the combination of yarns 32 and 52 generally designated 100 enter the jet through inlet 60. Compressed air or other pressurized gas enters the jet through pipe 22 and impinges on the yarn in the entrance 62 of yarn outlet orifice block 64. The yarn and high velocity gas travel together through outlet end 66 of the jet and travel around baffle 37*a* which is fixedly mounted to bracket 68 attached to the outlet end of the jet.

The central axis of baffle 37*a* is contained in a plane which is perpendicular to the central aixs of jet 37 and is located above the central axis of the jet such that the portion of the surface of the baffle nearest the central axis of the jet device is a distance A of from 0.1 to 3.0 minimum diameters of the bore downstream of the location where the pressurized gas contacts the yarn in the bore. More particularly, in the yarn outlet orifice block 64, said minimum diameter is the diameter indicated at location B. Preferably, distance A is from 0.5 to 1.5 minimum diameters. The baffle is also located a fixed distance C from the outlet end 66 of the jet's exhaust. This distance C is preferably in the range of from about 0.2 to about 1.2 of the minimum diameters referred to above. The size of the baffle 37*a* is selected so that the baffle is large enough to allow the yarn issuing from the jet outlet to travel 3.0 to 10.0, preferably 4.0 to 8.0 minimum diameters around said baffle before separating yarn from the gas flow.

In operation, yarn is passed through jet 37 where it is treated with pressurized gas, then propelled by the gas from the outlet end of the jet to baffle 37*a* and travels partially around the lower surface of the baffle, then leaves the baffle in an upward direction. Since the surface of the baffle nearest the central aixs is above the central axis of the jet, most of the gas is diverted around the lower surface of the baffle.

It is to be understood that the description "above" and "upward" is meant within the context of an upward threadline path from the feed rolls 35 to the take up rolls 39 as seen in FIG. 2. In some machines, threadline path is downward in flow, in which case descriptive terms above and upwards should mean below and downward.

Figure 5:
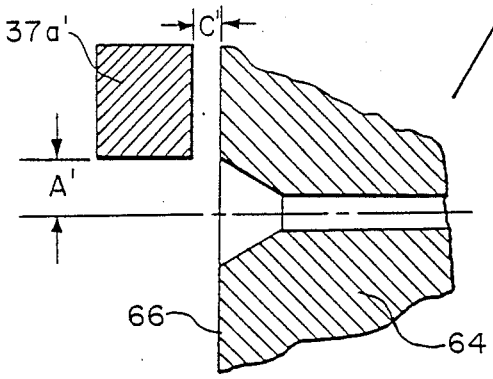
FIGS. 5 and 6 are partial views similar to FIG. 4 of the jet of this invention with baffles having square cross section, each oriented differently at the outlet end of the jet.
Figure 6:
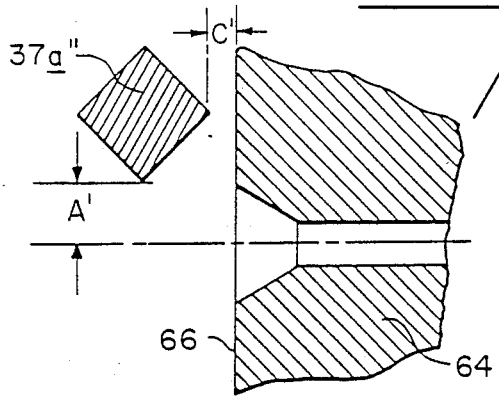

In the preferred embodiment of the jet illustrated in FIGS. 3 and 4, the baffle 37*a* is shown as a cylindrical rod with a circular cross section. FIGS. 5 and 6 illustrate alternate embodiments of the baffle in the form of polygons, in particular, square cross-section baffles 37*a* ', 37*a* ". In FIGS. 3 and 4 the distances C' and A' are from 0.5 to 1.0, preferably 0.5 to 0.9 minimum diameters and from 0.5 to 2.0, preferably 0.8 to 1.6 minimum diameters, respectively.

Figure 7:
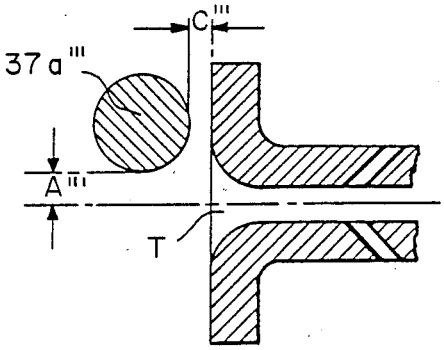
FIG. 7 is an illustration of a further embodiment showing the baffle in the form of a bar with a jet having a trumpet-like exit.

In FIG. 7 the relationship of the baffle 37*a* "' to the trumpet-like outlet end of the jet device is shown and the distances C"' and A"' are from 0.1 to 2.0, preferably 0.2 to 0.5 minimum diameters and from 0.1 to 3.0, preferably 0.2 to 2.0 minimum diameters respectively.

EXAMPLE

Figure 8:
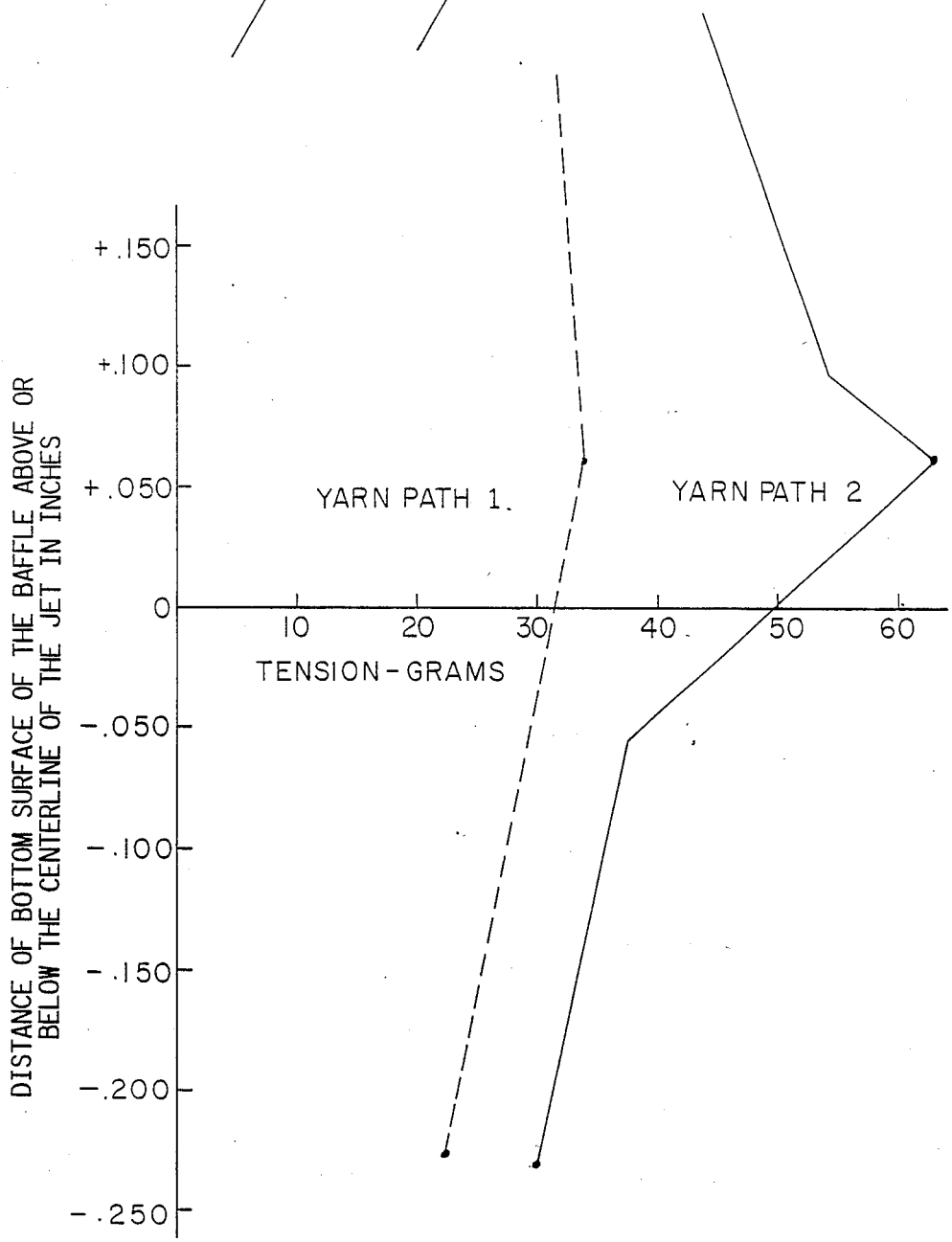
FIG. 8 is a graph of windup tension in grams vs. the position of the bottom surface of baffle from the center line of the jet, expressed in thousandths of an inch above or below said centerline, for two different paths for yarn exiting the jet.

Two ends of 150 denier—50 filament polyester yarn are fed into an air jet texturing system similar to that shown in FIG. 1. A jet of the type shown in FIGS. 3 and 4 is used to texture the yarn. Size of minimum diameter B in FIG. 4 is 0.070 inch and needle is size 28B. Yarn overfeed between rolls 16 and 24 in FIG. 1 is +35% and between rolls 16 and windup 28 is +24.5%. Distances A and C were 0.060 and 0.051 inches respectively and the diameter of the baffle (37*a*) is 0.469 inches. The textured yarn is wound up onto a package at 339 meters per minute and the air pressure to the jet 37 is 130 psi. Two different yarn paths at the outlet end of the jet were tested and windup tension is measured in each case at the same location between the nip roll and the windup. The paths are path 1 upward between the baffle and the outlet end of the jet to the nip roll and path 2 around the baffle then to the nip roll. Paths 1 and 2 are indicated on FIG. 4. The effect of path 1 and path 2 when the baffle is moved with respect to the center line of the jet is shown in FIG. 8. The windup tensions measured when baffle distance A, above jet centerline, was 0.060 inch are:

For Path 1, tension=34 grams

For Path 2, tension=64 grams (88% greater than Path 1)

In prior art use of jet described in FIG. 4 with baffle bar, of same 0.469 inch size as FIG. 8, located dead center opposite jet exit, windup tension measurements are:

For Path 1, tension=22.3 grams

For Path 2, tension=30.2 grams

The special arrangement of the baffle in the system of this invention brought about almost three-fold increase in texturing tension from conventional prior art level of 22.3 grams to excellent 64 gram level. Tension increase is exploited to yield more coherent yarn bundle, or yield same general yarn character but at a much higher, and more economical, texturing speed.

What is claimed is:

1. In a system for texturing one or more yarns that includes a source of supply for said yarns, a yarn treating jet positioned between a feed roll and a nip roll through which yarn passes for treating with pressurized fluid and means for taking yarn up onto a package under tension, said jet including a body having inlet and outlet ends connected by a central bore along a central axis, means for introducing pressurized gas through a gas inlet into said bore between said ends to contact yarn passing through the jet at a location in said bore, said yarn and said gas following a path from said outlet end of said jet, the improvement comprising: a baffle located adjacent the yarn outlet end of the jet, said baffle having a peripheral surface, the portion of said surface nearest said outlet end being a distance of 0.1 to 2.0 minimum diameters of the bore downstream of said location, the portion of said surface nearest said central axis being a distance of from 0.1 to 3.0 of said minimum diameters above said central axis and providing a guiding surface for said yarn around which said yarn travels in a path after it leaves the outlet end of the jet toward said windup.

2. The system of claim 1 wherein said baffle has a curvilinear surface, the portion of said surface nearest said outlet end being a distance from the exit end in the range of 0.1 to 1.5 of said minimum diameters and the portion of said surface nearest said central axis being a distance of from 0.1 to 2.0 of said minimum diameters above said central axis.

3. The system of claim 1 wherein said baffle is a bar having a square cross section oriented with adjacent flat surface portions facing said outlet end of the jet and said central axis, the flat surface portion nearest said outlet end being a distance from the outlet end of 0.5 to 1.0 of said minimum diameters and said flat surface portion nearest said central axis being a distance from said central axis of from 0.5 to 2.0 of said minimum diameters.

4. The system as defined in claim 1, said baffle being a bar having a square cross section oriented with adjacent corners facing said outlet end and said central axis, the corner adjacent said outlet end being a distance from said outlet end of from 0.5 to 1.0 of said minimum diameters and the corners adjacent, said central axis being a distance from said central axis of from 0.5 to 2.0 of said minimum diameters.

5. The system of claim 1 wherein said outlet end comprises curvilinear trumpet-like geometry, said baffle having a curvilinear surface.

6. The system of claim 5 wherein the portion of said surface nearest trumpet-like outlet end being a distance from the exit end in the range of 0.2 to 0.5 of said minimum diameters and the portion of said surface nearest said central axis being a distance of from 0.2 to 2.0 of said minimum diameters above said central axis.

7. The system of claims 1, 2, 5 or 6 including means for applying liquid to said yarn between said feed roll and the yarn inlet of the jet body.

8. The system of claim 7, wherein said means for applying liquid is a water bath, said yarn being immersed in said water prior to passing to the jet.

9. The system of claim 7, including means for drawing said yarn located between said source of supply for said yarns and said means for feeding yarn to applying liquid to said yarn, and means for stabilizing said yarn, by stretching said yarn in a stabilization zone from about 1 to about 15 percent said zone being located between said nip rolls and said means for taking yarn up onto a package.

10. The system of claim 9 including means for post heating said yarn in a zone downstream of said stabilization zone.

* * * * *